US007714679B2

(12) United States Patent
Jiang

(10) Patent No.: US 7,714,679 B2
(45) Date of Patent: May 11, 2010

(54) SPIRAL COUPLER

(75) Inventor: Xin Jiang, Chelmsford, MA (US)

(73) Assignee: Hittite Microwave Corporation, Chelmsford, MA (US)

( * ) Notice: Subject to any disclaimer, the term of this patent is extended or adjusted under 35 U.S.C. 154(b) by 142 days.

(21) Appl. No.: 12/011,724

(22) Filed: Jan. 29, 2008

(65) Prior Publication Data

US 2009/0189712 A1 Jul. 30, 2009

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/110, 111, 112, 115, 116, 238
See application file for complete search history.

(56) References Cited

U.S. PATENT DOCUMENTS 3,162,717 A 12/1964 Lentz
3,332,039 A 7/1967 Oh
3,516,024 A 6/1970 Lange
3,904,991 A * 9/1975 Ishii et al. ..... 333/116
4,636,754 A 1/1987 Presser et al.
4,800,345 A 1/1989 Podell et al.
5,521,563 A 5/1996 Mazzochette
5,818,308 A 10/1998 Tanaka et al.
6,346,863 B2 2/2002 Sasaki et al.
6,407,647 B1 6/2002 Apel et al.
6,636,126 B1 10/2003 Pozdeev
6,747,525 B2 6/2004 Iida et al.
6,765,455 B1 7/2004 DeLillo et al.
6,806,558 B2 10/2004 Apel
6,859,177 B2 2/2005 Pozdeev
7,127,808 B2 10/2006 McAndrew et al.
2003/0218516 A1 11/2003 Gilbert et al.
2004/0189388 A1 9/2004 Nguyen et al.
2005/0156700 A1 7/2005 Chang
2006/0220737 A1 10/2006 Sanderson

OTHER PUBLICATIONS

Written Opinion from International Searching Authority, PCT/US09/00084, dated Feb. 25, 2009, 5 pages (unnumbered).

Shibata et al., "Microstrip Spiral Directional Coupler," 1981, IEEE Transactions on Microwave Theory and Techniques, vol. MTT-29, No. 7, pp. 680-689.

Lange, Julius, "Interdigitated Stripline Quadrature Couplers Hybrid,"MTT Digest of Technical Papers, Dallas, Texas, May 5-7, 1969. pp. 10-13.

Tajima et al., "Monolithic Hybrid Quadrature Couplers (Braided Structures)," 1982, IEEE GaAs IC Symposium, pp. 154-155.

Shibata et al., "A Spiral Microwave Directional Coupler for MIC Application," IEEE Transactions on Microwave Theory and Techniques, vol. MTT-29, No. 7, Jul. 1981, pp. 477-479.

(Continued)

*Primary Examiner*—Dean O Takaoka
(74) *Attorney, Agent, or Firm*—Iandiorio Teska & Coleman

(57) ABSTRACT

An improved spiral coupler including a plurality of parallel, coextensive conductive strips disposed in a planar spiral path, including a first strip having an input port and a direct or through port, a second strip having a coupler port and an isolated port and a first cross-over connection for bridging the strips from the inside to the outside of the spiral path to provide all four the ports external access to the spiral path.

22 Claims, 8 Drawing Sheets

OTHER PUBLICATIONS

Waterman et al., "GaAs Monolithic Lange and Wilkinson Couplers," IEEE Transactions on Electron Devices, vol. ED-28, No. 2, Feb. 1981, pp. 212-216.

Brehm et al., "Monolithic GaAs Lange Coupler at X-Band," IEEE Transactions on Electron Devices, vol. ED-28, No. 2, Feb. 1981, pp. 217-218.

Kumar et al., "Monolithic GaAs Interdigitated Couplers," IEEE Transactions on Microwave Theory and Techniques, vol. 31, No. 1, Jan. 1983, pp. 29-32.

Kemp et al., "Ultra-Wideband Quadrature Coupler," Electronics Letters, Mar. 1983, vol. 19, No. 6, pp. 197-199.

* cited by examiner

SPIRAL COUPLER

FIELD OF THE INVENTION

This invention relates to an improved spiral coupler.

BACKGROUND OF THE INVENTION

With the dramatic developments of wireless telecommunication and satellite communication systems, there have been increasing demands for highly integrated RF and microwave circuits with better performance, smaller size and lower cost. Many of these systems use couplers, such as a 3-dB coupler and other directional couplers, in their microwave circuitry. Couplers of many types and variations have been developed for circuits processing signals at microwave frequencies. U.S. Pat. No. 3,516,024 was issued on Jun. 2, 1970 to Lange for an Interdigitated Strip Line Coupler. This coupler, also described in Lange, "Interdigitated Strip-Line Quadrature Hybrid", MTTS Digest of Technical Papers, Dallas, Tex., May 5-7, 1969, pp. 10-13, has become generally known as a Lange coupler. Since this early work on strip line conductors many variations have been developed.

These are variously described in Waterman, Jr., et al., "GaAs Monolithic Lange and Wilkinson Couplers", and Brehm et al., "Monolithic GaAs Lange Coupler at X-Band", both of IEEE Transactions on Electron Devices, Vol. ED-28, No. 2, February 1981, pages 212-216, and pages 217-218, respectively; Tajima et al., "Monolithic Hybrid Quadrature Couplers (Braided Structures)", IEEE GaAs IC Symposium, 1982, pages 154 and 155; Kumar et al., "Monolithic GaAs Interdigitated Couplers", IEEE, 1983, pages 359-362; Kemp et al., "Ultra-Wideband Quadrature Coupler", IEEE Transactions, 1983, pp. 197-199; Shibata et al., "Microstrip Spiral Directional Coupler", IEEE Transactions, 1981, pp. 680-689; Lentz, "Compact Transmission Line Consisting of Interleaved Conductor Strips and Shield Strips", U.S. Pat. No. 3,162,717 issued Dec. 22, 1964; Oh, "Three Conductor Coplanar Serpentine-line Directional Coupler", U.S. Pat. No. 3,332,039 issued Jul. 18, 1967; Presser et al., "High Performance Interdigitated Coupler with Additional Jumper Wire", U.S. Pat. No. 4,636,754 issued Jan. 13, 1987; and Podell et al., "Spiral Hybrid Coupler", U.S. Pat. No. 4,800,345 issued Jan. 24, 1989. All of these above cited references are herein incorporated in their entirety by this reference.

These various forms of interdigitated and strip-line conductors provide coupling with various degrees of success for different fabrication technology.

SUMMARY OF THE INVENTION

It is therefore an object of this invention to provide an improved spiral coupler.

It is a further object of this invention to provide such an improved spiral coupler suitable for semiconductor and other planar fabrication processes.

It is a further object of this invention to provide such an improved spiral coupler which has the simplicity of a Lange coupler but with reduced size and improved performance.

It is a further object of this invention to provide such an improved spiral coupler which improves isolation and directivity.

It is a further object of this invention to provide such an improved spiral coupler in which all ports of coupler are external to the spiral path.

The invention results from the realization that an improved spiral coupler can be achieved with a plurality of parallel coextensive conductive strips disposed in a planar spiral path, and a cross-over connection for bridging the strips from the inside to the outside of the spiral path to provide all four ports external to the spiral path.

The subject invention, however, in other embodiments, need not achieve all these objectives and the claims hereof should not be limited to structures or methods capable of achieving these objectives.

This invention features an improved spiral coupler including a plurality of parallel, coextensive conductive strips disposed in a planar spiral path, including a first strip having an input port and a direct or through port, a second strip having a coupler port and an isolated port; and a first cross-over connection for bridging said strips from the inside to the outside of said spiral path to provide all four said ports external access to said spiral path.

In a preferred embodiment the spiral path may be symmetrical and the first cross-over connection may be on the axis of symmetry. There may be only two the strips. The improved spiral coupler may further include a second cross-over connection for interchanging the relative positions of the first and second strips in the spiral path. The spiral path may be symmetrical and the second cross-over connection may be on the axis of symmetry. The second cross-over connection may be disposed at the midpoint of the spiral path. Each strip may include a plurality of discrete parallel elements interdigitated with those of the other strips. There may be a number of loops in the spiral path, each loop having first and second cross-over connections. The plurality of discrete elements in each strip may be shunted together at the cross-over connection to present a single conductive member for bridging. There may be a plurality of spaced shunts interconnected between the elements of each strip spaced along the spiral path.

This invention also features an improved four port spiral directional coupler including first and second parallel, coextensive conductive strips disposed in a planar spiral path, the first strip having an input port and a direct or through port, the second strip having a coupler port and an isolated port; and a first cross-over connection for bridging the strips from the inside to the outside of the spiral path to provide all four the ports external to the spiral path.

In a preferred embodiment the spiral path may be symmetrical and the first cross-over connection may be on the axis of symmetry. The improved four port spiral directional coupler may further include a second cross-over connection for interchanging the relative positions of the first and second strips in the spiral path. The second cross-over connection may be on the axis of symmetry. The second cross-over connection may be disposed at the midpoint of the spiral path. Each strip may include a plurality of discrete parallel elements interdigitated with those of the other strips.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
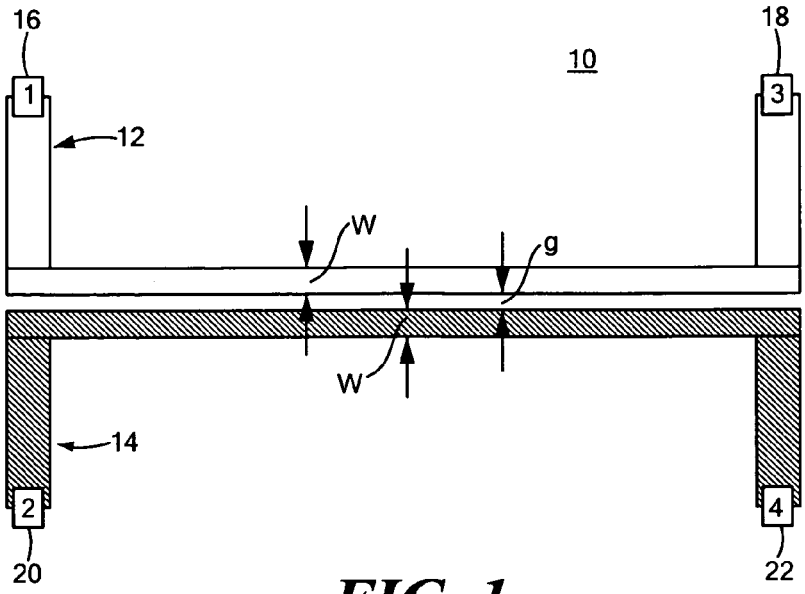
FIG. 1 PRIOR ART
FIG. 1 is a schematic plan diagram of a prior art directional coupler on a substrate.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

The invention presents a solution that not only reduces the size of directional couplers, especially the size of a Lange coupler, but also improves the isolation and directivity. The proposed topology only requires one layer of metals for strip lines and another layer for bridging the cross-over connections, similar to that in a standard Lange coupler. The dimensions of the resulting couplers can be reduced to one third to one sixth of standard quarter-wave length couplers. Two strip conductor sections of the couplers are wounded parallel to each other to form a complete spiral loop or loops by properly crossing over each other along the symmetrical central line. In this invention, the lengths of the coupled strip lines are equalized to each other and the symmetry of the structure enables the reciprocal responses between input port, coupled port, direct or through port and isolated port.

To preserve the structural symmetry in a spiral loop form, all of the four ports of the coupler are connected symmetrically to the outer circle of the spiral loops. In addition, at the interconnection between the inner circle and the outer inner circle loop, the two-conductor-strip pair of the coupler going from outer loop into the inner loop and the strip pair connecting from inner loop to outer loop cross-over each other. This can be realized by standard microstrip technologies both at the PCB board level and at the semi-conductor die level. The cross-over is located along the symmetrical center line of the coupler.

To keep the same line length of the coupled strips, the conductor strips are crossed over each other within the coupling pair at the middle point of the spiral loop. Thereby, each conductor strip runs half-way along the inner side of the loop and half-way along the outer side of the loop. For this purpose, cross-overs between the inner loop and the outer loop using conductors at a second layer can be employed. There are two alternative way to realize this: either using a cross-over over bridge for each strip as shown in the two strip coupler example shown in FIG. 4 or using a cross-over bridge after shunting multiple strips together as shown in the four strip coupler example in FIG. 5. The first type of cross-over introduces less parasitics and presents wider bandwidth, while the second type of cross-over helps to reduce the size of the cross-over section.

Figure 6:
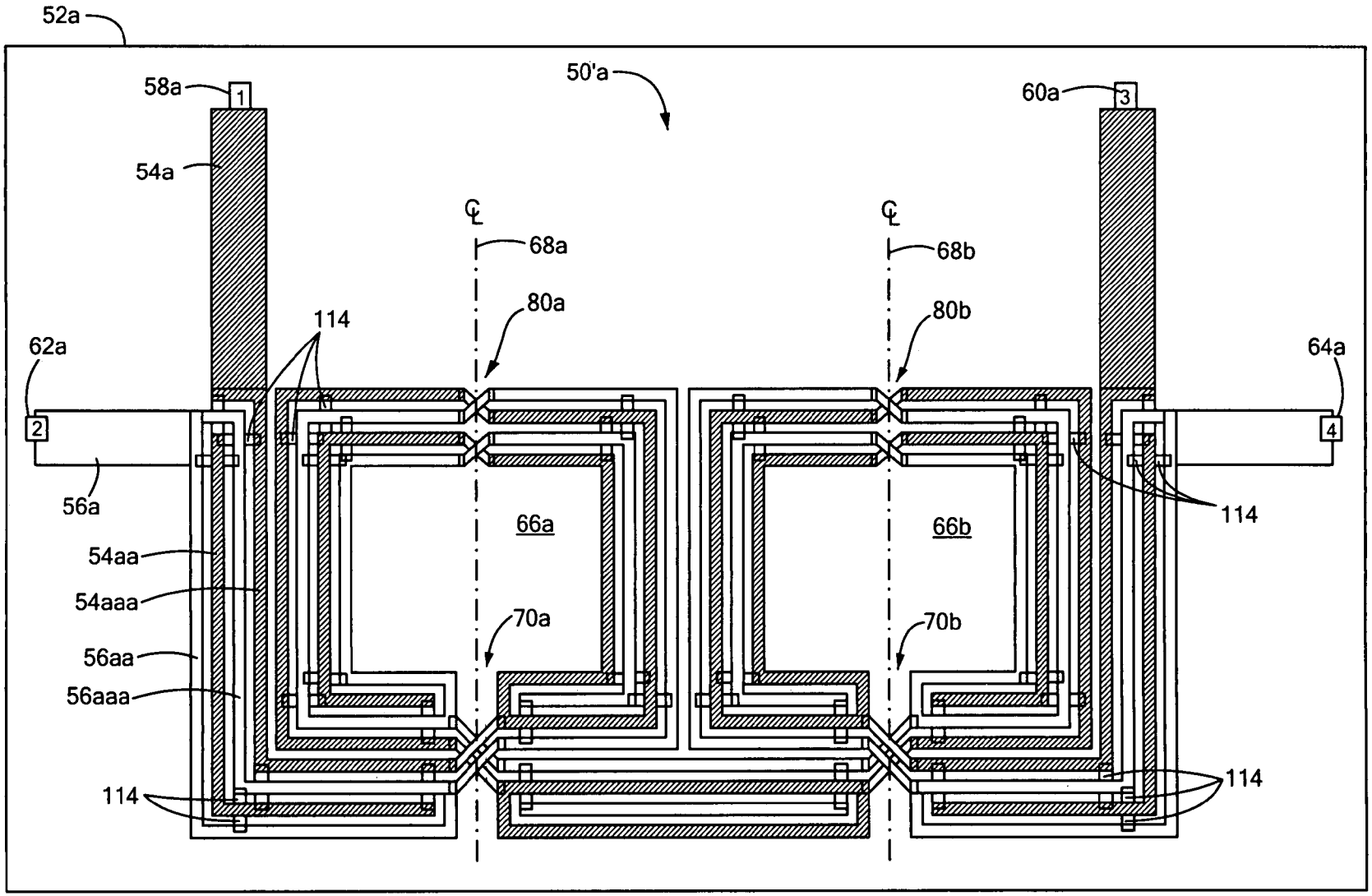
FIG. 6 is a view similar to FIG. 5 in which the spiral path contains two loops.
Figure 7:
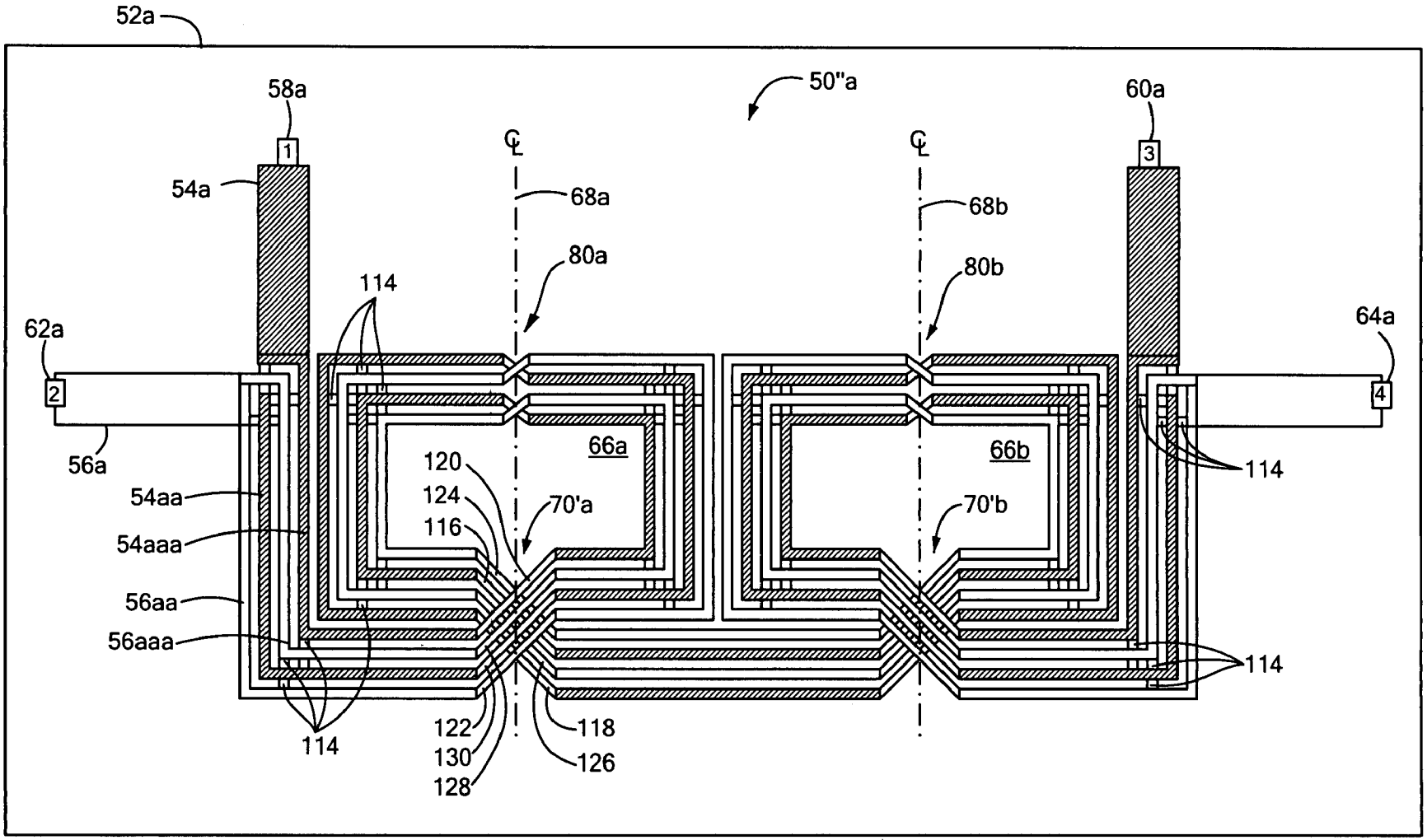
FIG. 7 is a view similar to FIG. 6 in which the elements in each strip are directly connected in parallel at the cross-over without being shunted together.
Figure 8:
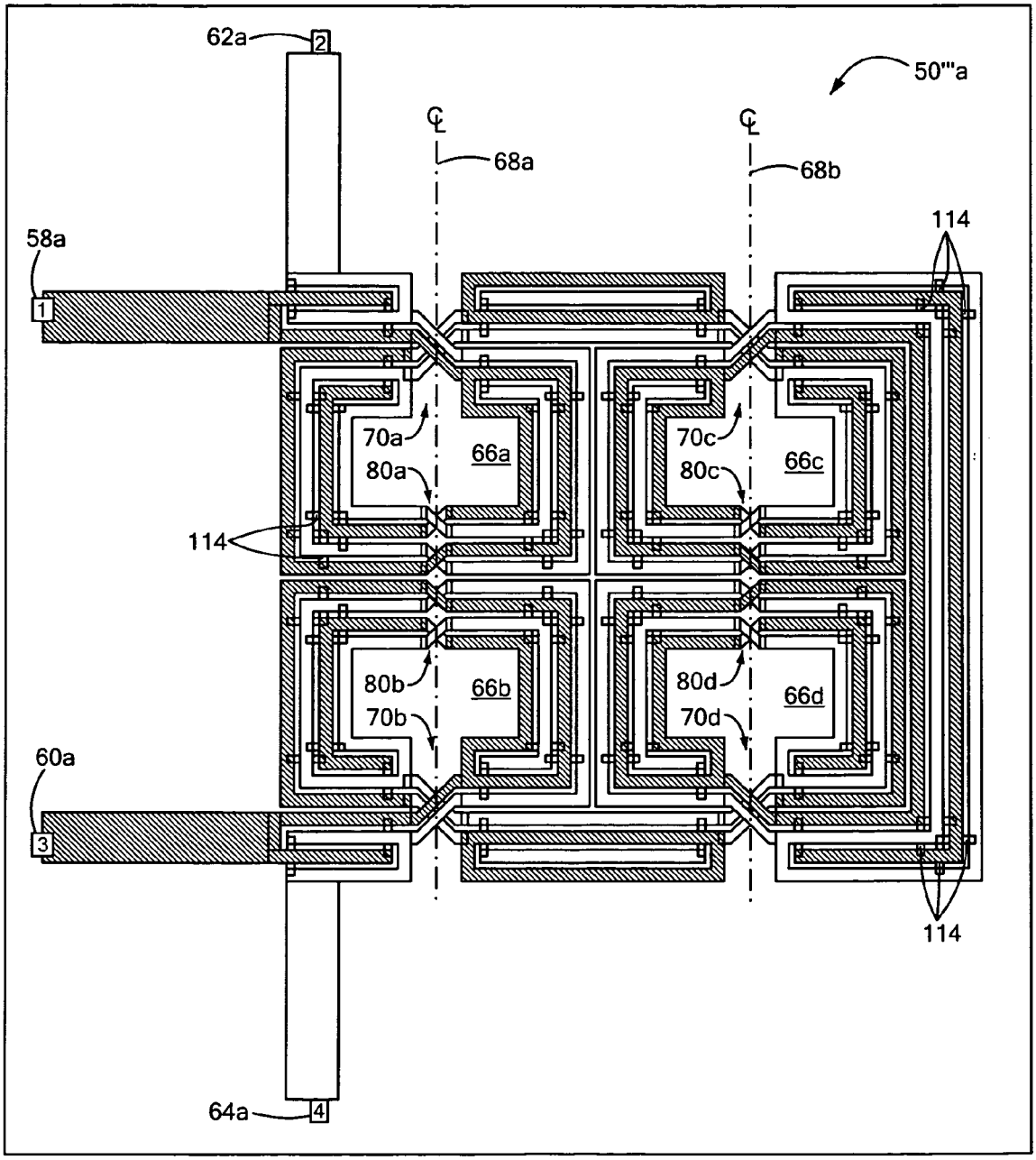
FIG. 8 is a view similar to FIG. 5 in which the spiral path contains four loops.
Figure 9:
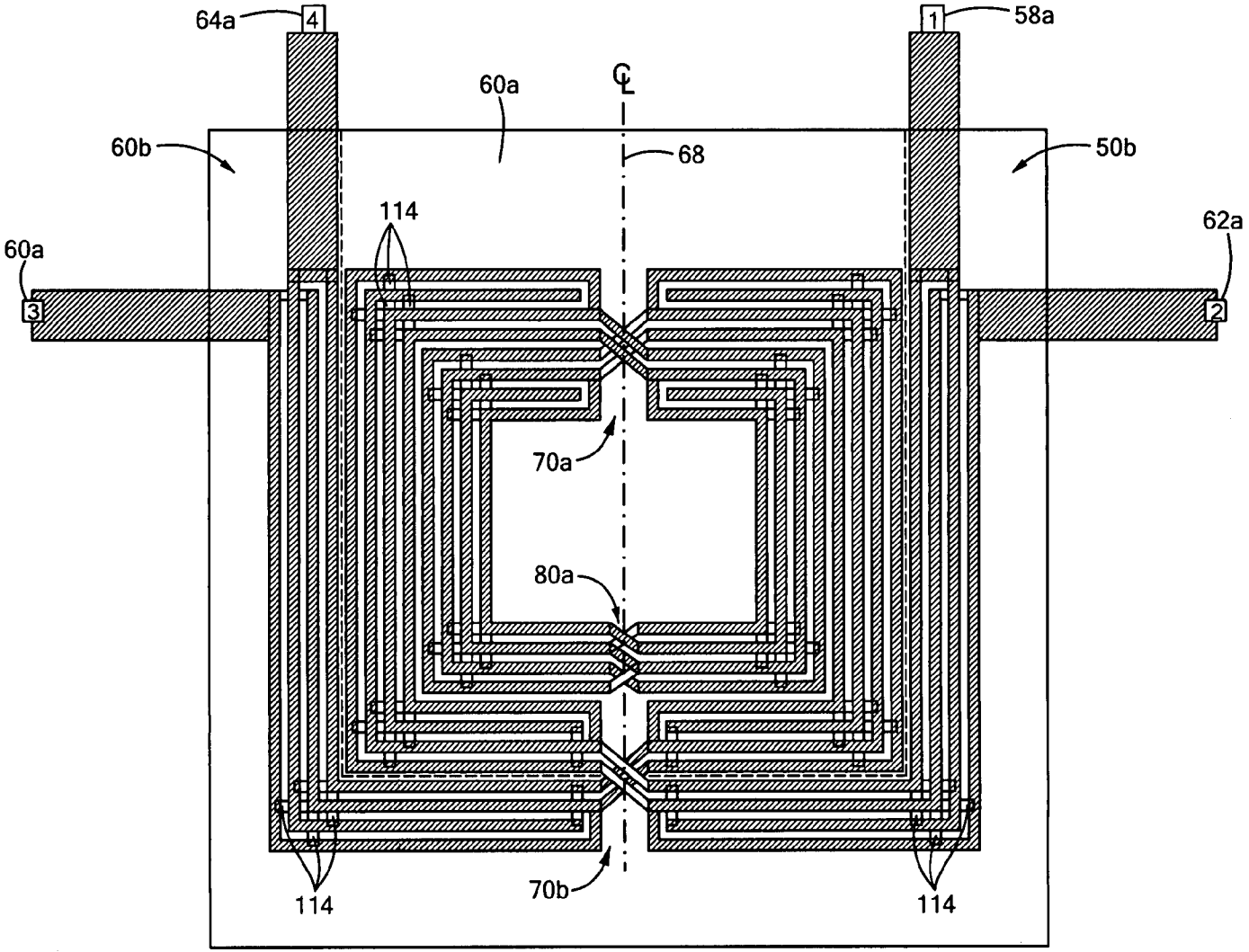
FIG. 9 is a view similar to FIG. 5 in which the spiral path contains a two-turn loop.

Besides equalizing the line lengths of the strips, the adjacent strips between inner and outer turns are from the same conductor and the electromagnetic wave propagates along the same direction. The couplers of this invention have higher even mode impedance than a regular un-folded coupler with same strip width and spacing, while the odd mode impedance is close to a regular un-folded coupler. With these properly controlled mutual couplings between loops, a high coupling ratio like 3-dB can be readily achieved over wide bandwidth without using small spacing between strips. In addition, high isolation and directivity can be obtained in the proposed spiral coupler. Besides these two cross-over bridges along the symmetrical center loop of the proposed coupler loop, cross-over connections may also be added near the corners of the loops to reduce the phase dispensing, which also helps to increase the coupling. To cover lower frequency or achieve smaller circuit size, several coupling loops can be cascaded in series to form a multiple-loop coupler, as shown in FIGS. 6-8, where two to four loops have been connected in series and the orientations between the adjacent loops have been arranged so that their mutual coupling helps to improve the overall performance. Another alternative approach is using multiple-turn spiral configuration by introducing more loops around the same center, as shown in FIG. 9, where a second loop with proper cross-over at the symmetric line is employed around the single loop version shown in FIG. 5.

Figure 2:
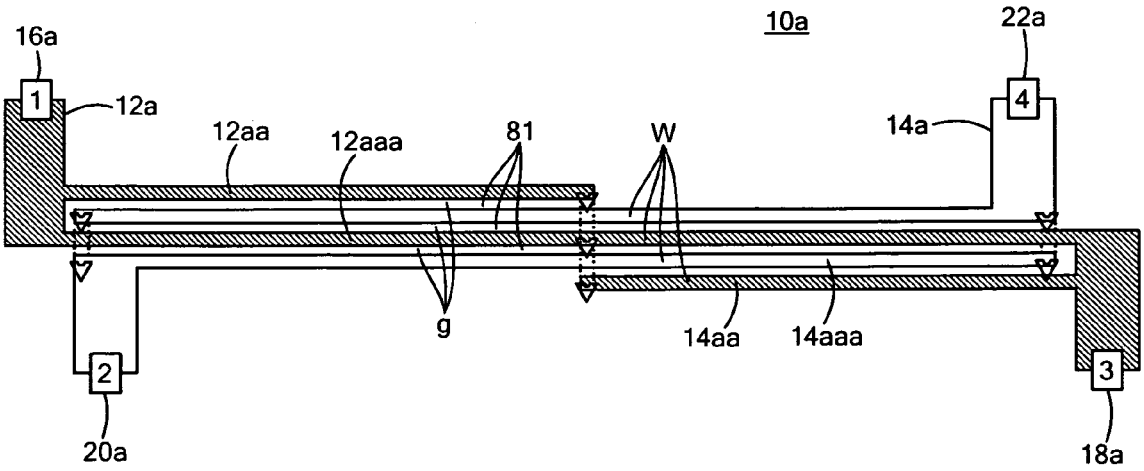
FIG. 2 PRIOR ART
FIG. 2 is a view similar to FIG. 1 of a prior art Lange type interdigitated directional coupler.

There is shown in FIG. 1 a prior art four port directional coupler 10 including two conductor strips 12 and 14. Strip 12 has an input port 16 and a direct or through port 18. Strip 14 has a coupled port 20 and an isolated port 22. The length of strip 12 and 14 are generally equal to ¼ of the wavelength of the center operating frequency, e.g. for couplers designed for 3 GHz applications, the length will be around 1 centimeter long if the circuit is fabricated using high frequency semiconductor process. The width of the strips and the gap between them are designed to optimize the efficiency of the coupling or transfer. The widths w of strips 12 and 14 and the gap g between them are generally uniform and are chosen to optimize the efficiency of transfer. A typical coupling efficiency is in the range of 10%, i.e. a coupling ration of 10-dB. An improvement is shown in the prior art device of, FIG. 2, where the four port directional coupler 10*a* is a Lange type wherein each strip 12*a*, and 14*a* is formed from a plurality of elements 12*aa*, and 12*aaa*, 14*aa*, and 14*aaa*. This provides much greater coupling with a transfer efficiency in the range of 50%, i.e. a coupling ration of 3-dB. The widths w of the elements 12*aa*, 12*aaa*, 14*aa*, 14*aaa* are generally uniform as are the gaps and all are chosen to optimize transfer efficiency.

Figure 3:
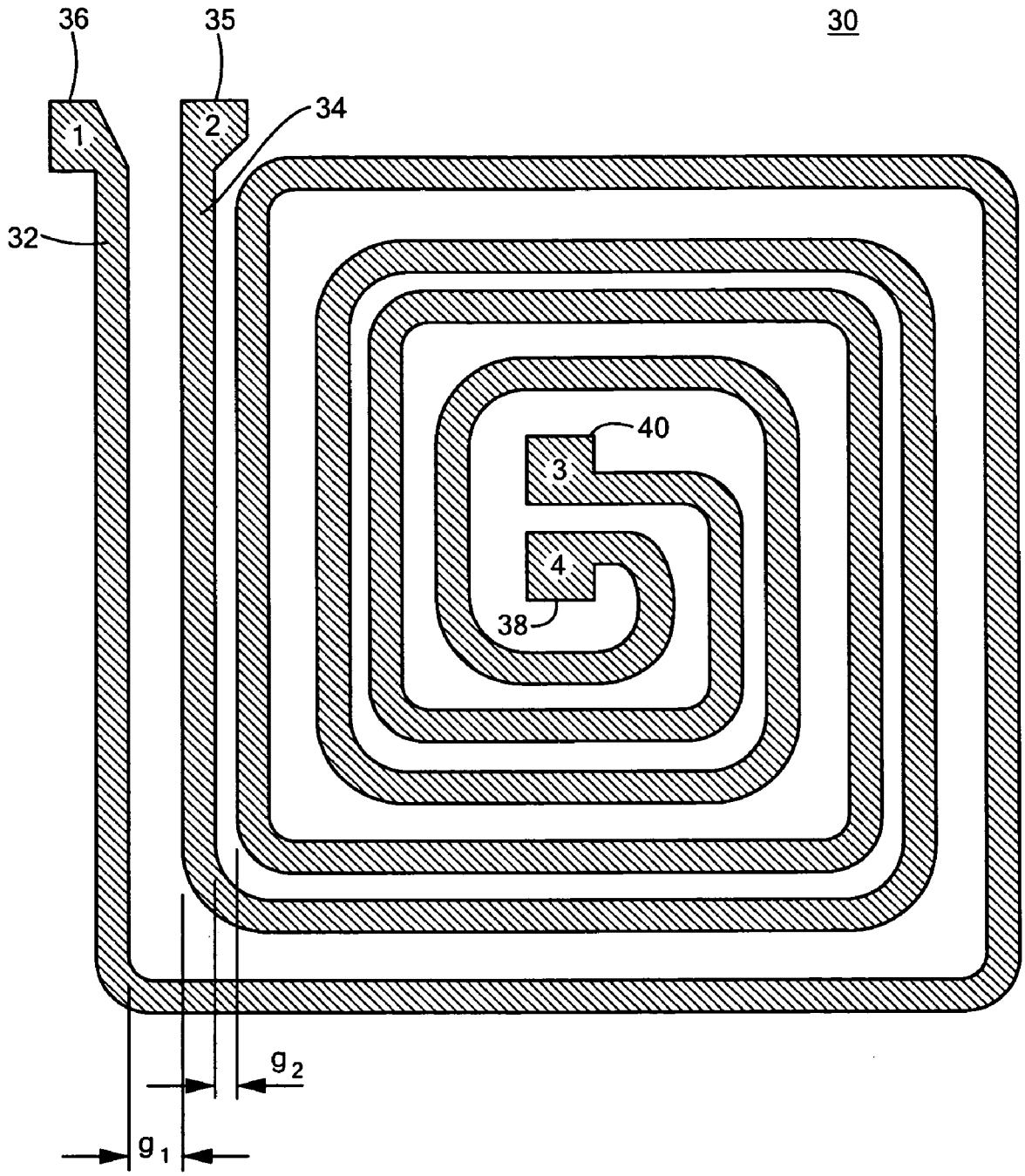
FIG. 3 PRIOR ART
FIG. 3 is a schematic plan diagram of a prior art spiral directional coupler.

In another prior art approach a four part directional coupler 30, FIG. 3, is configured as a planar spiral wherein two conductor strips 32 and 34 extend inwardly in a spiral beginning in input port 36 and coupled port 35 and terminating in direct or through port 40 and isolated port 38. One disadvantage of this design is that two of the ports, in this case, direct or through port 40 and isolated port 38 end up inside of the spiral where they are not easily accessible. Another shortcoming of the spiral coupler in FIG. 3, is that the width of the gap changes, for example, having a width g1 in one place and a width g2 in another in order to balance the coupling and equalize the coupling throughout the length of strips 32 and 34.

Figure 4:
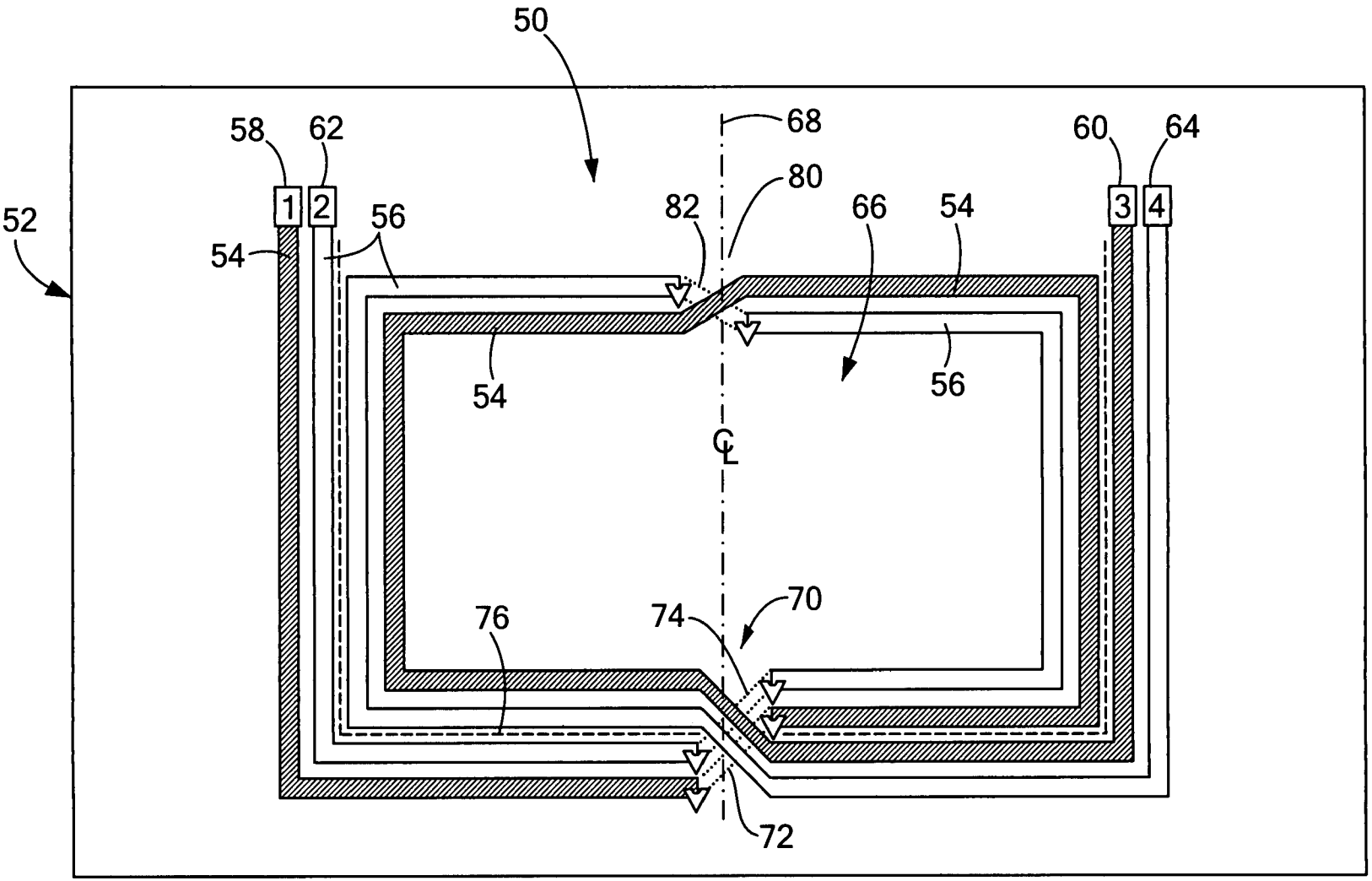
FIG. 4 is a schematic plan diagram of a spiral coupler according to this invention on a substrate.

An improved four port symmetrical spiral directional coupler 50, according to this invention, FIG. 4, may be disposed on a substrate, such as a suitable PCB board, semi-conductor substrate or other planar fabrication material 52. Spiral coupler 50 includes a plurality of conductive strips, for example, a first strip 54 and a second strip 56. Strip 54 has an input port 58 at one end and a direct or through port 60 at the other. Strip 56 has a coupled port 62 at one end and an isolated port 64 at the other. Spiral coupler 50 is the form of a single symmetrical loop 66 having a center line of symmetry 68. A first cross-over connection 70 is disposed at the center line of symmetry 68 and uses shunts 72 and 74 to direct strips 54 and 56 from the outside of spiral path depicted at 76 to the inside, thus allowing both the input and coupled ports 58 and 62 and the direct and isolated ports 60 and 64 to be external of the spiral path 76. A second cross-over connection 80 can also be employed using for example shunt 82 but in this case the cross-over connection is used to swap the relative position of strips 54 and 56. Thus, viewing from right to left at the top of the loop in FIG. 4, strip 54 is on the top or right and strip 56 is on the bottom or left. Following the swap at cross-over connection 80 strip 54 is on the left or bottom and strip 56 is on the right or top. This is done to equalize the length of the strips in the spiral and to further balance the coupling effect of coupler 50. While cross-over connection 70 is preferably located on the center line of symmetry 68, second cross-over connection 80 is preferably on the center line of symmetry 68 and also at the midpoint of strips 54 and 56.

Figure 5:
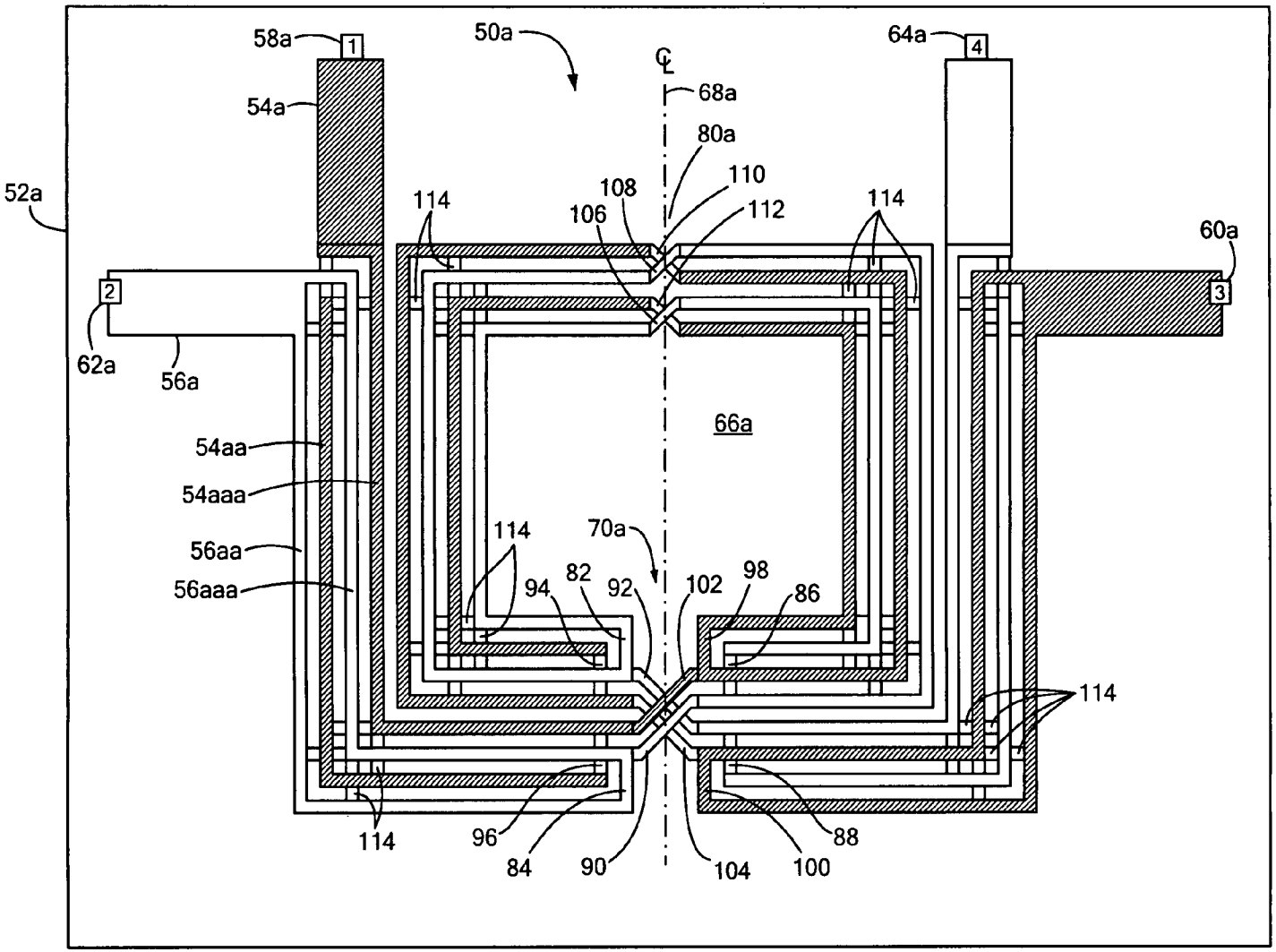
FIG. 5 is a view similar to FIG. 4 with each strip having discrete elements interdigitated with each other.

The approach of this invention as shown in FIG. 4 can be applied in an interdigitated configuration, FIG. 5, where coupler 50*a* includes a conductor strip 54*a* which has a plurality of conductive elements e.g. conductive elements 54*aa*, and 54*aaa* and strip 56*a* has a plurality of elements, e.g., conductive elements 56*aa* and 56*aaa*. Now in cross-over connection 70*a*, the ends of elements 56*aa*, and 56*aaa* are connected together at shunts 82 and 84 and also at shunts 86 and 88 and are interconnected by cross-over shunts 90 and 92. Likewise conductor elements 54*aa* and 54*aaa* have their ends connected together at shunts 94 and 96 and 98 and 100 and are interconnected by cross-over conductors 102 and 104. Similarly, but more simply, at second cross-over connection 80*a* elements 56*aa* and 56*aaa* are connected by cross-over shunts 106 and 108 and conductor elements 54*aa* and 54*aaa* are cross-over connected by shunts 110 and 112. Also shown in FIG. 5 are a plurality of auxiliary shunts 114 appearing throughout loop 66*a* of coupler 50*a*, most prevalently in the corner areas in order to further balance the coupling and improve transfer efficiency.

Although thus far the invention has been shown with a single loop in FIGS. 4 and 5 this is not a necessary limitation of the invention. As shown in FIG. 6 there may be two loops 66*a*, 66*b*, each with a first cross-over connection 70*a*, 70*b*, and a second cross-over connection 80*a*, 80*b*. FIG. 7, shows an alternative construction for the first cross-over connections 70*a*, 70*b* of FIG. 6. In FIG. 7, cross-over connections 70'*a* and 70'*b* do not use anticipatory shunts before entering the cross-over connections. Rather, four separate cross-over shunts 116, 118, 120, 122 are used for elements 54*aa* and 54*aaa* and four cross-over shunts 124, 126, 128, 130 for conductive elements 56*aa* and 56*aaa* and similar cross-over conductors are used in second cross connection 70'*b*. The coupler in accordance with this invention may be expanded as desired, for example, in FIG. 8, there is shown coupler 50'''*a* which includes in the spiral four loops, 66*a*, 66*b*, 66*c*, and 66*d*, each with its own first cross connection 70*a*, 70*b*, 70*c*, and 70*d* and second cross connection 80*a*, 80*b*, 80*c*, 80*d*. Also, the coupler in accordance this invention may be expanded around the same loop center, for example, in FIG. 9, there is shown 50*b* which includes an extra loop 60*a* around the loop 60*b* used in FIG. 5 and first cross-over connection 70*a*, and 70*b* and second cross-over connection 80*a* and 80*b*.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. An improved spiral coupler comprising;

a plurality of parallel, coextensive conductive strips disposed in a planar spiral path, including a first strip having an input port and a direct or through port, a second strip having a coupled port and an isolated port;

a first cross-over connection for bridging said strips over themselves from the inside to the outside of said spiral path to provide all four said ports external access to said spiral path; and a second cross-over connection for interchanging the relative positions of said first and second strips in the spiral path.

2. The improved spiral coupler of claim 1 in which said spiral path is symmetrical and said first cross-over connection is on the axis of symmetry.

3. The improved spiral coupler of claim 1 in which there are only two said strips.

4. The improved spiral coupler of claim 1 in which the input port and the coupled port are proximate each other, and the direct or through port and the isolated port are proximate each other.

5. The improved spiral coupler of claim 1 in which said spiral path is symmetrical and said second cross-over connection is on the axis of symmetry.

6. The improved spiral coupler of claim 1 in which said second cross-over connection is disposed at the midpoint of said spiral path.

7. The improved spiral coupler of claim 1 in which each strip includes a plurality of discrete parallel elements interdigitated with those of the other strips.

8. The improved spiral coupler of claim 1 in which there are a number of loops in said spiral path, each loop having first and second cross-over connections.

9. The improved spiral coupler of claim 7 in which the plurality of discrete elements in each strip are shunted together at said cross-over connection to present a single conductive member for bridging.

10. The improved spiral coupler of claim 7 in which there are a plurality of spaced shunts interconnected between the elements of each strip spaced along the spiral path.

11. An improved four port spiral directional coupler comprising;

first and second parallel, coextensive conductive strips disposed in a planar spiral path, said first strip having an input port and a direct or through port, said second strip having a coupled port and an isolated port;

a first cross-over connection for bridging said strips over themselves from the inside to the outside of said spiral path to provide all four said ports external to said spiral path; and a second cross-over connection for interchanging the relative positions of said first and second strips in the spiral path.

12. The improved four port spiral directional coupler of claim 11 in which said spiral path is symmetrical and said first cross-over connection is on the axis of symmetry.

13. The improved spiral coupler of claim 11 in which the input port and the coupled port are proximate each other, and the direct or through port and the isolated port are proximate each other.

14. The improved four port spiral directional coupler of claim 11 in which said second cross-over connection is on the axis of symmetry.

15. The improved four port spiral directional coupler of claim 11 in which said second cross-over connection is disposed at the midpoint of said spiral path.

16. The improved four port spiral directional coupler of claim 11 in which each strip includes a plurality of discrete parallel elements interdigitated with those of the other strips.

17. An improved spiral coupler comprising;

a plurality of parallel, coextensive conductive strips disposed in a planar spiral path, including a first strip having an input port and a direct or through port, a second strip having a coupled port and an isolated port, each strip including a plurality of discrete parallel elements interdigitated with those of the other strips;

a first cross-over connection for bridging said strips from the inside to the outside of said spiral path to provide all four said ports external access to said spiral path; and a second cross-over connection for interchanging the relative positions of said first and second strips in the spiral path.

18. The improved spiral coupler of claim 17 in which the plurality of discrete elements in each strip are shunted together at said cross-over connection to present a single conductive member for bridging.

19. The improved spiral coupler of claim 17 in which there are a plurality of spaced shunts interconnected between the elements of each strip spaced along the spiral path.

20. The improved spiral coupler of claim 17 in which the input port and the coupled port are on the opposite side of the spiral coupler than the direct or through port and the isolated port.

21. The improved spiral coupler of claim 19 in which the input port and the coupled port are on the opposite side of the spiral coupler than the direct or through port and the isolated port.

22. An improved four port spiral directional coupler comprising;

first and second parallel, coextensive conductive strips disposed in a planar spiral path, said first strip having an input port and a direct or through port, said second strip having a coupled port and an isolated port, each strip including a plurality of discrete parallel elements interdigitated with those of the other strips;

a first cross-over connection for bridging said strips from the inside to the outside of said spiral path to provide all four said ports external to said spiral path; and a second cross-over connection for interchanging the relative positions of said first and second strips in the spiral path.

* * * * *